US012550946B2

(12) United States Patent
Testoni et al.

(10) Patent No.: US 12,550,946 B2
(45) Date of Patent: Feb. 17, 2026

(54) MACHINE AND METHOD FOR FILLING AND CAPPING CARTRIDGES FOR ELECTRONIC CIGARETTES

(71) Applicant: G.D S.p.A., Bologna (IT)

(72) Inventors: Luca Testoni, Bologna (IT); Daniele Grosso, Bologna (IT); Luca Lanzarini, Bologna (IT); Alessio Frontini, Bologna (IT); Manuele Cucchi, Bologna (IT)

(73) Assignee: G.D S.p.A., Bologna (IT)

( * ) Notice: Subject to any disclaimer, the term of this patent is extended or adjusted under 35 U.S.C. 154(b) by 529 days.

(21) Appl. No.: 17/963,403

(22) Filed: Oct. 11, 2022

(65) Prior Publication Data

US 2023/0113542 A1 Apr. 13, 2023

(30) Foreign Application Priority Data

Oct. 12, 2021 (IT) ..... 102021000026081

(51) Int. Cl.

| | |
|---|---|
| ***A24F 40/70*** | (2020.01) |
| ***A24F 40/10*** | (2020.01) |
| ***B65B 3/04*** | (2006.01) |
| ***B65B 7/28*** | (2006.01) |

(52) U.S. Cl.

CPC ..... *A24F 40/70* (2020.01); *A24F 40/10* (2020.01); *B65B 3/04* (2013.01); *B65B 7/28* (2013.01)

(58) Field of Classification Search

CPC . A24F 40/70; A24F 40/10; B65B 3/04; B65B 7/28

USPC ..... 53/471

See application file for complete search history.

(56) References Cited

U.S. PATENT DOCUMENTS

2016/0338408 A1* 11/2016 Guenther, Jr. ..... B23P 19/002
2021/0171231 A1* 6/2021 Bumatai ..... B65B 3/12

FOREIGN PATENT DOCUMENTS

IT 201900009288 A1 12/2020

OTHER PUBLICATIONS

Search Report dated Jun. 2, 2022. 8 pages.

* cited by examiner

*Primary Examiner* — Robert F Long
*Assistant Examiner* — Xavier A Madison
(74) *Attorney, Agent, or Firm* — RMCK Law Group PLC

(57) ABSTRACT

A machine for filling and capping cartridges for electronic-cigarettes includes a transport line for feeding cartridges; a transfer unit for transferring the cartridges from a feeding line to the transport line; a station for dispensing a predetermined quantity of product into the cartridges; a station for applying a cap to each cartridge filled with product; a system for feeding caps to the cap application station including a conveyor for transporting the caps thereto according to a pre-established formation, and a unit for detecting the caps transported by the conveyor; a control unit for checking possible empty spots in the formation of the transported caps, based on detection data provided by the detection unit, and for transmitting a stop signal to at least one among the transfer unit, the product dispensing unit and the cap application station, if an empty spot is identified in the formation of the caps.

12 Claims, 3 Drawing Sheets

MACHINE AND METHOD FOR FILLING AND CAPPING CARTRIDGES FOR ELECTRONIC CIGARETTES

CROSS-REFERENCE TO RELATED APPLICATION

This application claims priority to Italian Patent Application No. 102021000026081 filed Oct. 12, 2021. The disclosure of the above application is incorporated herein by reference in its entirety.

FIELD AND BACKGROUND

The present invention relates to a machine and a method for filling and capping cartridges for electronic cigarettes.

In particular, the present invention relates to an application in which the aforesaid machine comprises:

- a cartridge transport line for feeding the cartridges in succession along a feed path;
- a transfer unit for transferring the cartridges from a cartridge feeding line to the transport line; a product-dispensing station for dispensing a predetermined quantity of product into the empty cartridges;
- an application station for applying at least one cap to each cartridge filled with product, for closing the cartridge so as to impede the outflow of the product;
- a system for feeding caps to the cap application station.

A persistent technical problem for machines of the aforementioned type is that of the need to improve the performance of the machine while maintaining high production quality.

This problem is associated with a considerable number of difficulties in the operations concerned with feeding the caps to the application station, owing to the small size and very light weight of the caps.

Furthermore, the operation of prior art machines sometimes entails considerable wastage of the processed cartridges, due to malfunctions in the operations of feeding the caps to the application station. In this context, the object of the present invention is to provide a machine for filling and capping cartridges for electronic cigarettes which is capable of overcoming the drawbacks of the prior art.

OBJECT AND SUMMARY

This object is achieved by means of a machine for filling and capping cartridges for electronic cigarettes according to Claim 1.

The present invention also relates to a method according to Claim 9.

The claims form an integral part of the teachings provided here.

BRIEF DESCRIPTION OF THE DRAWINGS

Further characteristics and advantages of the invention will be apparent from the following description, which refers to the attached drawings provided purely by way of non-limiting example, in which.

DESCRIPTION

The following description illustrates various specific details intended to provide a deeper understanding of the embodiments. The embodiments may be realized without one or more of the specific details, or with other methods, components or materials, etc. In other cases, known structures, materials or operations are not shown or described in detail, to avoid obscuring various aspects of the embodiment.

The references used here are purely for convenience and therefore do not define the scope of protection or the extent of the embodiments.

Figure 3:
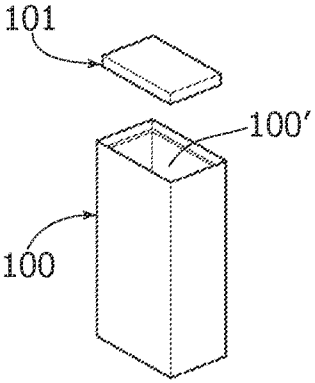
FIG. 3 shows an example of a cartridge for electronic cigarettes.

FIG. 3 shows an example of a single-use cartridge for electronic cigarettes; The illustrated cartridge 100 comprises a main body provided with an inner chamber for containing a flavoured liquid for evaporation when the cartridge is used with the electronic cigarette. The main body of the cartridge 100 has an opening 100' through which the inner chamber is filled with the flavoured liquid during the cartridge production process, and which is subsequently closed by a cap 101, to prevent the outflow of the liquid and to preserve its properties until the cartridge is used.

Figure 1:
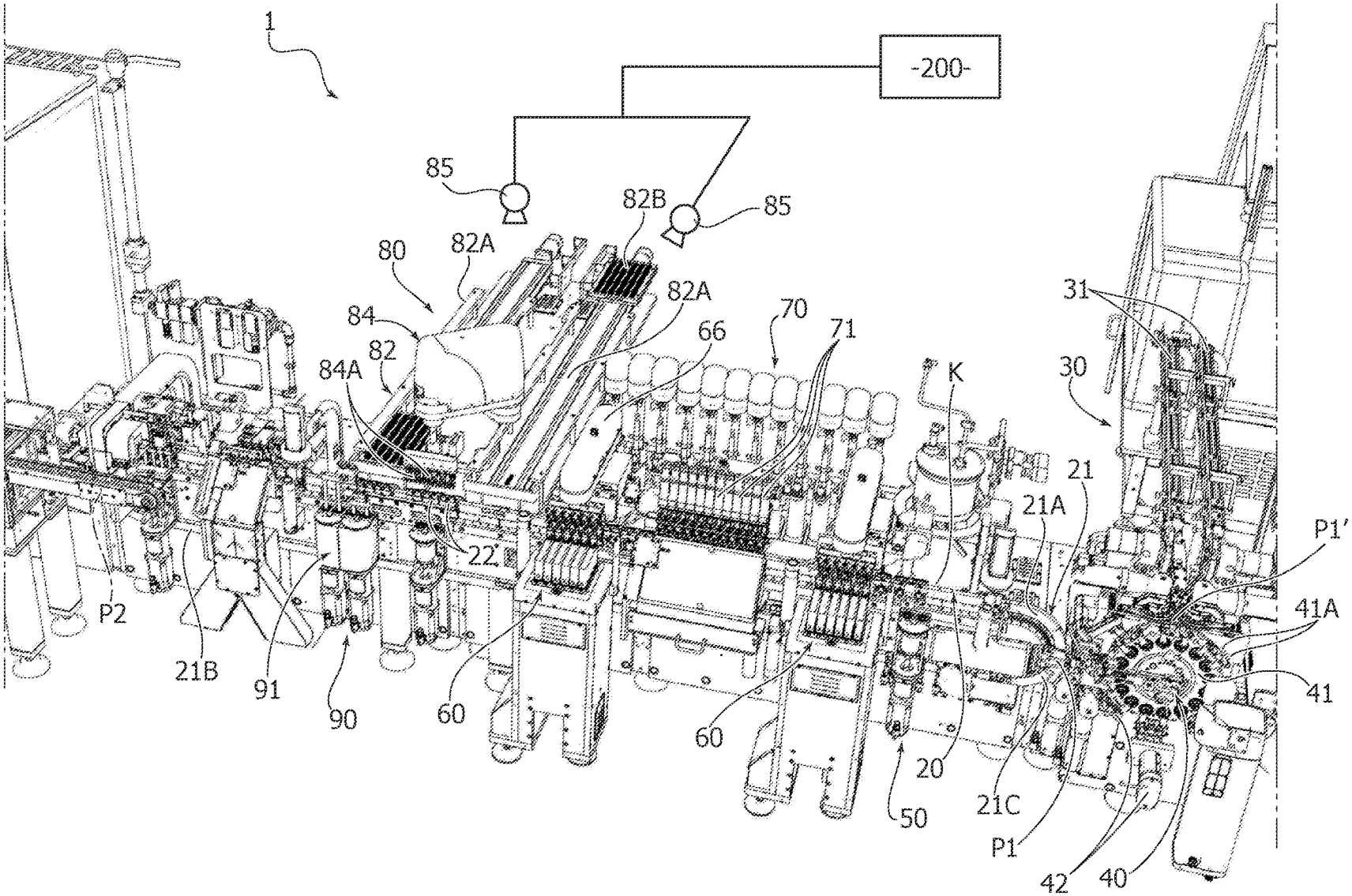
FIG. 1 shows schematically an example of the machine for filling and capping cartridges described herein.

FIG. 1 shows an example of the machine for filling and capping cartridges described herein.

The illustrated machine, indicated as a whole by the reference numeral 1, comprises a transport line 20 for transporting the cartridges 100 along a feed path K.

In one or more preferred embodiments, such as that illustrated, the transport line 20 comprises a guide 21 extending along a closed ring-shaped path, and a set of elements 22 that are movable on the guide 21. Each of the elements 22 is provided with one or more seats for housing the cartridges 100.

In one or more preferred embodiments, such as that illustrated, the guide 21 has an upper portion 21A defining the feed path K, along which the elements 22 carrying the cartridges 100 advance, and a lower portion 21B that forms a path for the return of the empty elements 22.

At an upstream end of the transport line 2, the machine 1 comprises a line 30 for supplying cartridges 100.

The line 30 may, for example, comprise one or more channels 31 for transporting the cartridges 100 through air which is blown into these channels.

In one or more preferred embodiments, such as that illustrated, the machine 1 further comprises a unit 40 for transferring the cartridges from the line 30 to the transport line 20.

In one or more preferred embodiments, such as that illustrated, the unit 40 comprises a wheel 41 which is rotatable about a horizontal axis of rotation, and which is arranged, in its peripheral region that has a plurality of seats 41A distributed around the axis of rotation, for receiving the cartridges 100. In operation, the wheel 41 carries the individual cartridges 100 from a position P1', in which it receives an individual cartridge 100 from the line 30 in a corresponding seat 41A, to a position P1, in which it delivers the cartridge 100 to the transport line 20.

In one or more preferred embodiments, such as that illustrated, the unit 40 may also be designed for preparing and/or monitoring the cartridges 100 before they are delivered to the transport line 20.

In one or more preferred embodiments, the unit 40 is designed to perform the following functions:

checking for the presence of the cartridges;

marking the cartridges;

checking the marking carried out on the cartridges;

checking for the presence of a component of the cartridges such as a sealing grommet. According to such preferred embodiments, a series of devices 42 are arranged around the wheel 41 for performing one or more of the aforesaid functions on the cartridges 100 carried by the wheel 41. The movement of the wheel 41 is stepwise and provides stop positions in which its seats 41A are at the devices 42.

In one or more preferred embodiments, such as that illustrated, the delivery position P1 directly faces a portion 21C of the guide 21 that connects the lower return branch 21B to the upper branch 21A defining the feed path K.

The empty elements 22 are placed in the delivery position and pick the cartridges 100 from the wheel 41.

In one or more preferred embodiments, such as that illustrated, the machine 1 further comprises a station 50 for controlling a component of the cartridges 100, such as an electrical resistance. The control station 50 may, for example, comprise a device 51 for connecting the electrical resistance carried by an individual cartridge to an electrical power source, and a sensor for measuring the electric current, generated in this way, that flows through said electrical resistance.

In one or more preferred embodiments, the connecting device may comprise a movable terminal member for bringing electrical contacts against the electrical contacts of the cartridge that are connected to the electrical resistance to be tested.

Figure 2:
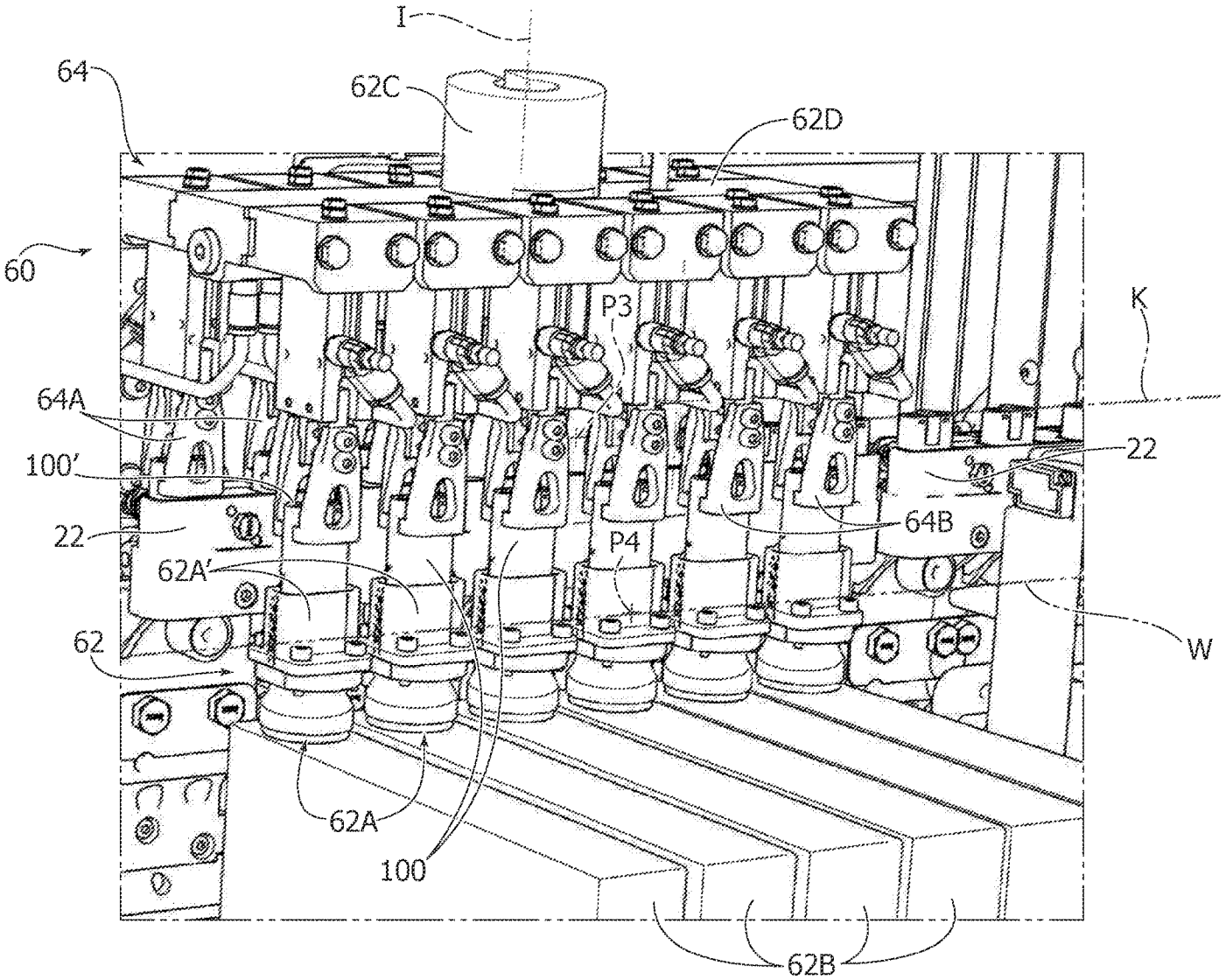
FIG. 2 shows a preferred embodiment of the operating station described here, in an axonometric view.

In one or more preferred embodiments, such as that illustrated, the machine 1 further comprises an operating station 60 designed for performing a given operation on the cartridges 100, the station comprising (FIG. 2):

an operating device 62 comprising a plurality of operating posts 62A for operating on the cartridges 100, the posts being arranged in series along a direction W parallel to the feed path K; and a device 64 for transferring the cartridges 100, the device comprising a first and a second set of pick-up members 64A, 64B and being drivable in a rotary movement around a vertical axis of rotation I, for selectively changing the positions of the first and second sets of pick-up members between a collection/discharge position P3 at the transport line 20 and an operating position P4 at the operating posts 62A of the operating device 62.

Each set has a number of pick-up members 64A, 64B corresponding to the number of operating posts 62A of the operating device 62.

In the collection/discharge position at the transport line 20, the pick-up members 64A or 64B of each set pick up or release cartridges 100 from/to corresponding moving elements 22. On the other hand, in operating position at the operating posts 62A of the operating device 62, the pick-up members of each set pick up or release cartridges 100 from/to the operating posts 62A, or keep the cartridges 100 in position between said operating posts.

Preferably, but not exclusively, the pick-up members 64A, 64B of each set for picking up or releasing the cartridges 100 are also moved vertically downwards and upwards. This is true both if the cartridges 100 are to be picked up/released from/to the moving elements 22 and if the cartridges 100 are to be picked up/released from/to different operating posts that are described more fully below (for example, the 62° posts described below).

In the operating posts 62A, the cartridges 100 are subjected to one or more operations.

In one or more preferred embodiments, the operating device 62 comprises a weighing unit and the corresponding operating posts 62A are weighing posts.

Preferably, each weighing post 62A comprises a seat 62A' positioned on a balance 62B; the seat 62A' comprises a cavity in which a single cartridge 100 is received in a condition in which it is kept in an upright position and has its opening 100', for the introduction of a liquid into the cartridge, facing upwards.

In operation, while a group of cartridges 100 is weighed in the weighing posts 62A, the transport line 20 is actuated so as to bring a new group of cartridges 100 on corresponding elements 22 into the operating station 50.

After the weighing operation has been completed, the transfer device 62 is then actuated so as to exchange the positions of the newly weighed group of cartridges 100, which are at the post 62A, and the new group of cartridges 100 that have entered the operating station 60 and are located on the transport line 20.

The group of cartridges 100 that have already been weighed are released (by a downward vertical movement of the pick-up members 64A, 64B, for example) on to the elements 22 with which the new group of cartridges 100 has arrived at the operating station 60, and then continue to follow, on these elements, the feed path K of the transport line 20.

In one or more preferred embodiments, such as that which is illustrated, the axis of rotation I of the transfer device 62 is in an intermediate position between the transport line 20 and the weighing posts 62A of the device 62.

Preferably, the transfer device 62 is suspended on a support frame that extends in a direction transverse to the feed path K and projects over the transport line 20.

In one or more preferred embodiments, such as that which is illustrated, the transfer device 62 comprises a connecting portion 62C for mounting the device rotatably around the axis of rotation I. The transfer device 62 also comprises at least one cross-piece 62D, which is connected centrally to the connecting portion 62C, and which carries the two sets of pick-up members 62A, 62B on respective sides in mutually opposed positions with respect to the axis of rotation I. The pick-up members 62A, 62B may, for example, be pincer-like members or suction grip members.

It should be noted here that the operating station 60 described above may be arranged for performing any operation on the cartridges 100. Consequently, the operating device may be arranged with operating means that may vary according to the requirements of specific applications.

In one or more preferred embodiments, the operating device 62 may, for example, comprise:

a detection unit for detecting the cartridges 100, and/or a test unit for performing a test on the cartridges 100, and/or a processing unit for carrying out a process on the cartridges 100.

In one embodiment, the operating device 62 further comprises a by-pass path along which are arranged the operating means of the device, for example the aforesaid weighing unit, detection unit, test unit and processing unit. In this case, the cartridges 100 follow this by-pass path before being returned to the feed path K of the transport line 20.

In one or more preferred embodiments, such as that illustrated, the machine 1 comprises a station 70 for filling the cartridges 100, after these, while still empty, have been weighed in the operating station 60.

The filling station 70 may, for example, comprise a plurality of dispensing units with needles 71, which are designed to insert their needles through the upper openings and into the interior of cartridges 100 carried by elements 22 that are positioned simultaneously in the filling station 70, in mutually adjacent positions along the feed path K. The filling of the cartridges 100 preferably includes the dispensing of a flowing product, for example a liquid product, a granular product, a gel, or other types.

In one or more preferred embodiments, the machine 1 comprises a further operating station 60', for weighing the cartridges 100 filled with product, in order to check that they have been correctly filled by the unit 70. The operating station 60' may have the same structure and the same mode of operation as those described above with reference to the operating station 60.

In one or more preferred embodiments, such as that illustrated, the machine 1 comprises a station 80 for capping the cartridges 100 and a system 82 for feeding plugs or caps 101 to the station 80.

In one or more preferred embodiments, such as that illustrated, the feed system 82 comprises at least one conveyor 82A for transporting a plurality of caps 101 on a tray 82B to a position for delivering the caps 101, immediately adjacent to the transport line 20. The tray 82B has an ordered formation of housings 82B' for receiving the caps 101 according to a corresponding ordered formation.

The station 80 comprises a device 84 for applying the caps 101 to the cartridges 100 carried by the elements 22 of the transport line 20. The application device 84 is designed to pick up the caps 101 singly or in groups from the tray in the delivery position, and to apply them to the cartridges 100 on the elements 22 which are positioned in the station 80.

Preferably, the feed system 82 comprises two conveyors 82A designed to operate in alternation, in interaction with the application device 84, so that, when the caps on a tray on one of the two conveyors are about to be used up, a new full tray is immediately made available in the delivery position by the other conveyor.

Preferably, the application device 84 consists of a pick and place device provided with a terminal unit for picking up the caps 101. The terminal unit may comprise a plurality of pick-up members 84A.

Preferably, the capping station 80 may also comprise a centring device (not shown) for correcting the positioning of the caps 101 and the cartridges 100 relative to each other, so as to align them on respective common axes, in order to ensure that they are correctly coupled to each other.

According to an important characteristic of the machine described herein, the machine 1 comprises a unit 85 for detecting the caps 101 transported on the tray 82B by the conveyor 82A. The unit 85 may, for example, be a fixed or manoeuvrable video camera, capable of photographing, preferably from above, the tray 82B moved by the conveyor 82A. In the example shown in FIG. 1, the machine 1 comprises two video cameras 85 for photographing the trays 82B that are moved by the two conveyors 82A of the machine.

The machine 1 further comprises at least one control unit 200 for checking possible empty spots in the formation of the caps 101 transported by the tray 82B, on the basis of detection data provided by the detection unit 85, and for transmitting a stop signal for a specified work cycle to at least one among the transfer unit 40, the product dispensing unit 70 and the station 80 for applying the caps 101, if an empty spot is identified in the pre-established formation of the caps 101 on the tray 82B.

In one or more preferred embodiments, the control unit 200 is configured to determine the work cycle for which the stop signal is to be transmitted, on the basis of the position of the empty spot in the formation of the caps 101 on the tray 82B.

In one or more preferred embodiments, the control unit 200 is configured to transmit a stop signal for a specified work cycle to the transfer unit 40.

Consequently, in the specified work cycle, the unit 40 does not transfer any cartridges 100 to the element 22 of the transport line 20, which at this point is in the delivery position P1.

This element therefore remains empty and advances in this state all the way along the feed path K.

Preferably, the work cycle for which the stop signal is transmitted is determined so that the element 22 remaining empty is then positioned, after its advance along the path K, in the station 80 for applying the caps 101 when the empty spot detected in the formation of the caps 101 on the tray 82B is positioned at the station 80 itself.

In one or more preferred embodiments, the control unit 200 is also configured to transmit a stop signal for a specified work cycle to the station 80 for applying the caps 101.

Preferably, as mentioned above, the application device 84 comprises a pick-up unit provided with at least one pick-up member 84A.

Preferably, the work cycle for which the stop signal is transmitted is determined so that the pick-up member 84A of the application device 84 is stopped when the empty element 22 is positioned at the application station 80.

Thus the application device 84 skips over any attempt to pick up from the tray 82B a cap 101 that is not in fact present, and to apply it to a cartridge 100 transported by the line 20.

In one or more preferred embodiments, the control unit 200 is also configured to transmit a stop signal for a specified work cycle to the filling station 70.

Preferably, as mentioned above, the filling station 70 comprises at least one product dispensing unit 71.

Preferably, the work cycle for which the stop signal is transmitted is determined so that the dispensing unit 71 is stopped when the empty element 22 is positioned at the filling station 70.

Thus, the filling station 70 skips over any dispensing of the product.

In one or more preferred embodiments, such as that illustrated, the pick-up unit of the application device 84 comprises a plurality of pick-up members 84A, capable of operating simultaneously to pick up a plurality of caps 101 from tray 82B, and to apply the plurality of caps picked up to a plurality of cartridges 100 on respective elements 22 located in adjacent positions along the feed path K within the application station 80.

In one or more preferred embodiments, such as that illustrated, the pick-up unit of the filling station 70 comprises a plurality of dispensing units 71, capable of dispensing the product simultaneously into a plurality of cartridges 100 on respective elements 22 located in adjacent positions along the feed path K within the application station 70.

In one or more preferred embodiments, the control unit 200 is configured to determine a pick-up unit and/or a dispensing unit to be stopped, on the basis of the position of the empty spot in the formation of the caps 101 on the tray 82B.

In the aforesaid preferred embodiments, the control unit 200 is configured to transmit a stop signal to the transfer unit 40 so that the element 22 remaining empty is then located, within the station 80, in the position corresponding to that into which the pick-up member 84A is moved when it does not carry any caps.

Similarly, the control unit 200 is configured to transmit a stop signal to the filling unit 70 so that the dispensing unit 71 that is stopped is the unit intended to operate on the empty element 22, among the plurality of elements 22 located simultaneously in the filling station 70.

Figure 5:
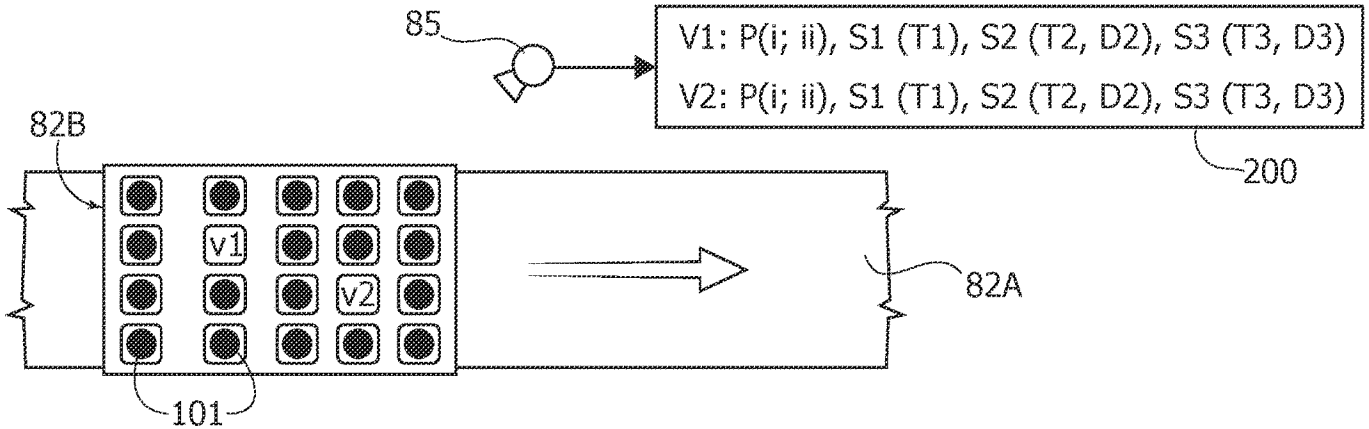
FIG. 5 shows an example of a mode of operation of the machine described herein.

FIG. 5 shows schematically an example of the operation of the control unit 200.

In particular, this figure represents a case in which two empty spaces V1, V2 are present on the tray 82B carrying the formation of the caps 101.

First, the video camera 85 photographs the tray 82B while the latter is advancing towards the station 80, and transmits the image of the tray to the control unit 200.

The control unit 80 identifies the two empty spots V1, V2 in the formation of the caps 100, and determines for each one a data set P(i; ii) indicating the position of the empty spot in the formation of the caps 101.

Then, on the basis of the determined data set, the control unit 200 generates, for each empty spot, stop signals S1, S2, and S3, for the transfer unit 40, the filling station 70 and the application station 80, respectively.

The stop signal S1 contains data T1 indicating one or more work cycles to be stopped, in other words those cycles in which no cartridge 100 is to be received in the receiving position P1', and no transfer of a cartridge 100 to the transport line 20 is to be carried out in the delivery position P1.

The stop signal S2 contains data T2 indicating at least one work cycle to be stopped, in other words those cycles in which no product is to be dispensed, and data D2 indicating the dispensing unit 71 to be stopped, among the plurality of dispensing units 71 with which the filling station 70 is provided.

The stop signal S3 contains data T3 indicating one or more work cycles to be stopped, in other words those cycles in which no caps 101 are to be picked up from the tray 82B, and in which no operation for applying the caps 101 is to be performed, and data D3 indicating the pick-up unit 84 to be stopped, among the plurality of pick-up units 84A with which the application station 80 is provided.

To determine the data T1, T2, T3, D2, D3, the control unit may use predictive algorithms for calculating future operating states of the various devices of the machine, using actual operating states of said devices as input data.

In view of the above, it will be apparent that the control unit 200 may be configured to transmit a stop signal to the other stations of the machine, for example the operating stations 60 described above, or to stations 90 and 110 which are described below, in order to stop the operations specified for these stations during the normal functioning of the machine from being carried out on the empty element 22, containing no cartridge, that travels all the way along the feed path K.

In one or more preferred embodiments, such as that illustrated, the machine 1 further comprises a station 90 for pressing the caps 101 already applied to the cartridges 100, in order to push them into a final position for sealing the cartridges 100.

The station 90 may, for example, comprise a device 91 arranged to compress the assembly formed by the individual cartridge 100 and the corresponding cap 101, by acting on opposite sides in engagement with the cartridge 100 on one side and with the cap 101 on the opposite side.

The compression device may, for example, comprise two opposed members, driven linearly along the common axis of the cartridge 100 and of the cap 101.

In one or more preferred embodiments, such as that illustrated, the machine 1 further comprises a station 110 for checking for the correct insertion of the cap 101 (and/or the presence/absence of the cap 101) on the cartridge 100.

Figure 4:
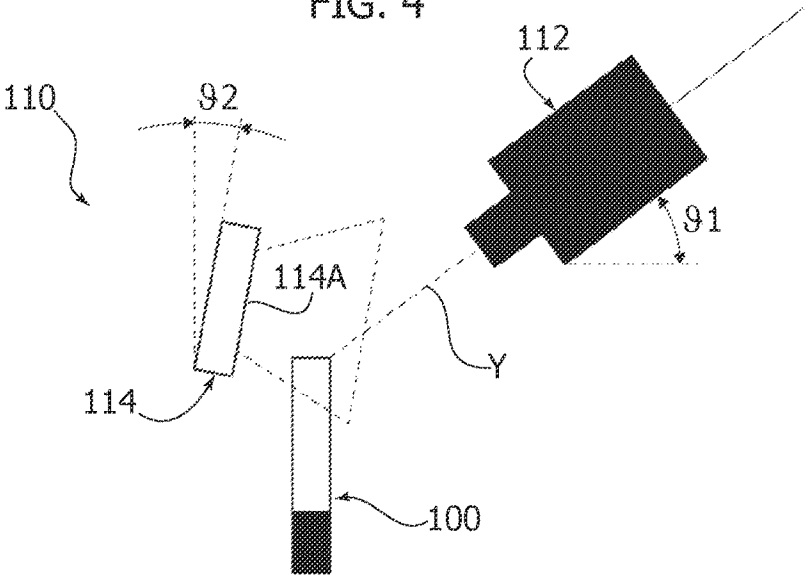
FIG. 4 shows details of a station of the machine described herein.

With reference to FIG. 4, the station 110 comprises a chamber 112 placed above the transport line 20 and facing downwards, towards the cartridges 100 on the elements 22, so as to orientate its optical axis Y along a direction inclined at an angle q1 of between 40° and 45° to a horizontal direction. Preferably, the optical axis Y is positioned in a vertical plane transverse to the plane in which the transport line 20 extends.

Additionally, in one or more preferred embodiments, such as that illustrated, the station 110 comprises a light source 114, which is placed in a position opposite to that of the camera 112 with respect to a cartridge 100 on an element 22 located in said station, and which has a light-emitting surface 114A facing downwards towards the cartridges 100 on the elements 22, and, in particular, inclined at an angle q2 of between 5° and 10°, and preferably equal to 5°, to a vertical direction.

Because of this particular arrangement of the camera 112 and the light source 114, the station 110 can detect the correct insertion of the cap 101 (and/or the absence or presence of the cap 101), regardless of the colour of the cap 101 and of the cartridge 100. This is because the inclination of the optical axis Y along a direction inclined with respect to a horizontal direction, as described above, facilitates the identification of any possible "gap" between the cap 101 (which must be in contact with the edge of the cartridge 100 when correctly inserted) and the edge of the cartridge 100 (in other words, the upper part of the opening 100').

Furthermore, if the cap 101 has not been correctly inserted to seal the opening 100', one or more areas of shadow and/or reflection, clearly identifiable by means of the camera 112, may be determined in the upper part of the cartridge 100. Conversely, when the cap 101 has been correctly inserted, a fully illuminated surface, formed by the cap 101 and the upper region of the cartridge 100, is presented to the camera.

The station 110 therefore determines the correct insertion of the cap 101 by identifying the absence or presence of the aforesaid area of shadow (and/or of any reflections). Evidently, this check may also be extended to the presence or absence of the cap 101.

Downstream of the station 90 or 110, the transport line 20 terminates in a downstream end that defines a position P2 for the delivery of the cartridges 100, filled and sealed with the caps 101, to a downstream line (not shown) for any further processing of the cartridges 100 and/or for their packaging.

In one or more alternative embodiments (not shown), the machine 1 may provide an operation in which, when the video camera 85 detects the presence of empty spots in the formation of caps transported on the tray 82B, auxiliary operations are commenced in order to supply the missing caps to the application station 80. According to a first mode of operation, the machine 1 has, for this purpose, an auxiliary tray containing a reserve stock of caps, which is moved to the application station 80 by the same conveyor 82A or by an additional auxiliary conveyor, only if empty spots are present in the formation of caps transported on the tray 82B. In a second mode of operation, the machine 1 generates a warning signal for an operator, who intervenes to insert the missing caps manually into the empty spots detected in the formation of caps transported on the tray 82B.

Clearly, provided that the principle of the invention is retained, the details of construction and forms of embodiment can be varied, even to a significant degree, from what has been illustrated herein purely by way of non-limiting example, without thereby departing from the scope of the invention, as defined in the attached claims.

The invention claimed is:

1. A machine for filling and capping cartridges for electronic cigarettes, the machine comprising:

a transport line configured to feed the cartridges in succession along a feed path;

a transfer unit configured to transfer the cartridges from a line for feeding the cartridges, to the transport line;

a product dispensing station configured to dispense a predetermined quantity of a product into the cartridges that are empty;

a cap application station positioned after the product dispensing station and configured to apply at least one cap to each cartridge filled with product, the at least one cap configured to close the cartridge so as to impede an outflow of the product;

a system configured to feed caps of the at least one cap to the cap application station;

wherein the system configured to feed caps comprises at least one conveyor configured to transfer the caps to the cap application station according to a pre-established formation, and a detection unit configured to detect the caps transported by the at least one conveyor;

at least one control unit programmed and configured to verify possible empty spots in the pre-established formation of the caps being transported by the at least one conveyor, on a basis of detection data provided by the detection unit, and configured to transmit a stop signal for a work cycle, to at least one among the transfer unit, the product-dispensing station and the cap application station, if an empty spot in the pre-established formation of the caps being transported by the at least one conveyor is detected.

2. The machine according to claim 1, wherein the at least one control unit is configured to determine the work cycle to transmit the stop signal for, as a function of a position of the empty spot in the pre-established formation of the caps being transported by the conveyor.

3. The machine according to claim 1, wherein the system configured to feed the caps comprises at least one tray which is moved by the at least one conveyor and is provided with an ordered formation of receptacles for receiving the pre-established formation of caps.

4. The machine according to claim 3, wherein the detection unit comprises a camera.

5. The machine according to claim 4, wherein the camera is configured to capture the ordered formation of the at least one tray's receptacles containing the pre-established formation of caps, particularly during the at least one tray's movement to the cap application station.

6. The machine according to claim 2, wherein the transport line comprises a plurality of spots in succession to one another, each spot configured to receive one of the cartridges from the transfer unit; and wherein the at least one control unit is configured to transmit to the transfer unit, the stop signal for the determined work cycle that is such that on the transport unit a spot of the plurality of spots in the transport line remains empty, which empty spot moves along the feeding path and is configured to be positioned at the cap application station when the empty spot detected in the pre-established formation of the caps being transported by the at least one conveyor is also at the cap application station.

7. The machine according to claim 6, wherein the cap application station comprises a gripping unit for gripping the caps that is provided with at least one gripping member, and wherein the at least one control unit is configured to transmit to the cap application station the stop signal for the determined work cycle that is such that the at least one gripping member is stopped when the empty spot of the transport line is at the cap application station.

8. The machine according to claim 6, wherein the product dispensing station comprises at least one dispensing unit, and wherein the at least one control unit is configured to transmit, to the dispensing station, the stop signal for the determined work cycle that is such that the at least one dispensing unit is stopped when the empty spot of the transport line is at the product dispensing station.

9. A process for filling and capping cartridges for electronic cigarettes, comprising the steps of:

by means of a transfer unit, transferring the cartridges from a line supplying cartridges to a transport line;

by means of the transport line, feeding the cartridges in succession along a feeding path;

by means of a product dispensing station, dispensing a predetermined quantity of a product for filling cartridges that are empty, fed by the transport line;

by means of a supplying system, supplying caps to a cap application station, for which is configured to apply the caps on the cartridges fed by the transport line;

by means of the cap application station, which is positioned after or downstream of the product dispensing station, applying at least one cap on each cartridge filled with product, the at least one cap configured to close the cartridge so as to impede the product from flowing out;

wherein supplying the caps includes:

transporting the caps to the cap application station, in a pre-established formation, and by means of a detection unit that is configured to detect the caps, detecting the caps being transported to the cap application station, the process further comprising:

by means of detection data provided by the detection unit, determining via a control unit if there is an empty spot in the pre-established formation of the caps and, if the empty spot is detected in the pre-established formation of caps, the control unit is programmed and configured to command stopping at least one among the transfer unit, the unit for dispensing the product and the cap application station, in a determined work cycle.

10. The process according to claim 9, wherein the transport line comprises a plurality of spots in succession to one another, each spot configured to receive a cartridge from the transfer unit; and wherein, if the empty spot is detected in the pre-established formation of the caps, the process includes stopping the transfer unit in the determined work cycle, so as to leave a spot of the plurality of spots empty in the transport line, the process further comprising moving said empty spot along the feeding path and bringing said empty spot to the cap application station when the empty spot detected in the pre-established formation of the caps is also at the application station.

11. The process according to claim 10, wherein the cap application station comprises a gripping unit for gripping caps that is provided with at least one gripping member, and wherein, if the empty spot is detected in the pre-established formation of the caps, the process includes stopping the at least one gripping member of the gripping unit, when the empty spot in the transport line is at the cap application station.

12. The process according to claim 10, wherein the product dispensing station comprises at least one dispensing unit, and wherein, if the empty spot is detected in the pre-established formation of the caps, the process comprises stopping the at least one dispensing unit, when the empty spot in the transport line is at the product dispensing station.

* * * * *